US005390797A

United States Patent [19]

Smalley et al.

[11] Patent Number: 5,390,797

[45] Date of Patent: Feb. 21, 1995

[54] FOOD-CARRYING CASE

[76] Inventors: Chris Smalley; Dave Shiers, both of 13739 Kinbrook St., Sylmar, Calif. 91342

[21] Appl. No.: 72,035

[22] Filed: Jun. 3, 1993

[51] Int. Cl.[6] ..... B65D 81/38; F25D 3/08

[52] U.S. Cl. ..... 206/542; 62/457.7; 62/457.9; 206/545; 220/412; 220/522

[58] Field of Search ..... 62/371, 372, 457.7, 62/457.9; 206/541, 542, 545; 220/23.83, 212, 412, 413, 532, 533, 521, 522

[56] References Cited

U.S. PATENT DOCUMENTS

| | | | |
|---|---|---|---|
| 3,025,947 | 3/1962 | Hammer | 206/545 |
| 3,225,983 | 12/1965 | Majka | 62/371 |
| 3,381,782 | 5/1968 | Ikelheimer | 220/533 |
| 3,705,222 | 12/1972 | Rogers et al. | 206/455 |
| 4,024,731 | 5/1977 | Branscum | 62/457.7 |
| 4,375,828 | 3/1983 | Biddison | 62/371 |
| 4,499,998 | 2/1985 | Carlson | 206/541 |
| 4,541,540 | 9/1985 | Gretz | 220/412 |
| 4,923,077 | 5/1990 | Van Iperen et al. | 62/457.7 |
| 5,181,612 | 1/1993 | Liu | 206/542 |

*Primary Examiner*—Jimmy G. Foster
*Attorney, Agent, or Firm*—Erik M. Arnhem

[57] ABSTRACT

A food-carrying container is constructed to resemble a conventional tote case so that a person can carry his or her lunch to an office without attracting undue attention or concern by other people. The food-carrying case includes a tray and hinged lid that have mating insulative foam liners. The tray case may be internally partitioned to form at least four insulated compartments. A thermal bottle, containing cold thermally active material, is mounted within the lid to maintain the associated food items at a desired temperature until the time at which the food items are to be consumed.

2 Claims, 2 Drawing Sheets

FOOD-CARRYING CASE

BACKGROUND OF THE INVENTION

1. Field of the Invention

This invention relates to an insulated container for a person's lunch. The container is designed to have the external appearance of a modern tote case.

2. Prior Development

Insulated containers for beverages or lunches are known. U.S. Pat. No. 4,019,340 to H. Conklin, discloses a food container formed of an insulating material. The lid of the container has a pocket therein for pre-charged cooling material, whereby food items placed in the container can be cooled to a desired temperature.

U.S. Pat. No. 4,050,264 to M. Tanaka discloses a food container having a floating inner lid that holds a freezable material. The lid rests directly on the food items, thereby effectively reducing the space that needs to be cooled.

U.S. Pat. No. 4,106,597, to R. L. Shook et al, discloses a food container having the external appearance of an attache case. A block of insulating material within the container has pockets for holding various food or beverage receptacles. The food container has no provision for heating or cooling the food items; therefore the container may not be suitable for holding perishable food items.

U.S. Pat. No. 4,441,336 to J. Cannon, shows a portable cooler having an elongated hollow upright partition containing a freezable material, e.g. water. Side surfaces of the partition have arcuate indentations, such that cylindrical cans of pop placed in the container alongside the partition have good thermal engagement with the freezable material. The partition is removable for refreezing material.

SUMMARY OF THE INVENTION

The present invention relates to a lunch box having the external appearance of a tote case, whereby a person can bring his or her lunch to their office or school without allowing the food products to spoil which is often the case with a conventional lunch box. The box of this invention can be built to resemble a modern attache case or tote box, such that other persons viewing the box would not be aware that the box contains the person's lunch.

The box can comprise a partitioned tray that forms multiple removable closed compartments when the lid is in the closed position. At least one thermal bottle can be mounted in the insulated lid of the box to cool the associated compartments. The insulated compartments in the tray may be insulated by means of a foam rubber liner fitting snugly into the bottom of the tray, whereby such compartments are fully (completely) insulated against thermal flow through the compartment walls. Foam rubber liners in the tray and in the lid mate together, so that the upper annular edge of a given foam liner in the tray seals against the lower annular edge of a mating liner in the lid when the lid is in the closed position. The mated foam liners in the tray and lid cooperatively insulate the defined compartments so as to form a complete and fully effective thermal barrier.

THE DRAWINGS

FIG. 1 is a perspective view of a food-carrying case embodying the present invention.

FIG. 2. is an enlarged sectional view taken on line 2—2 in FIG. 1, but with the lid of the case in a closed position.

FIGS. 3 and 4 are plan views of the portions of other case construction constructed according to the invention.

DESCRIPTION OF A PREFERRED EMBODIMENT OF THE INVENTION

Figure 1:
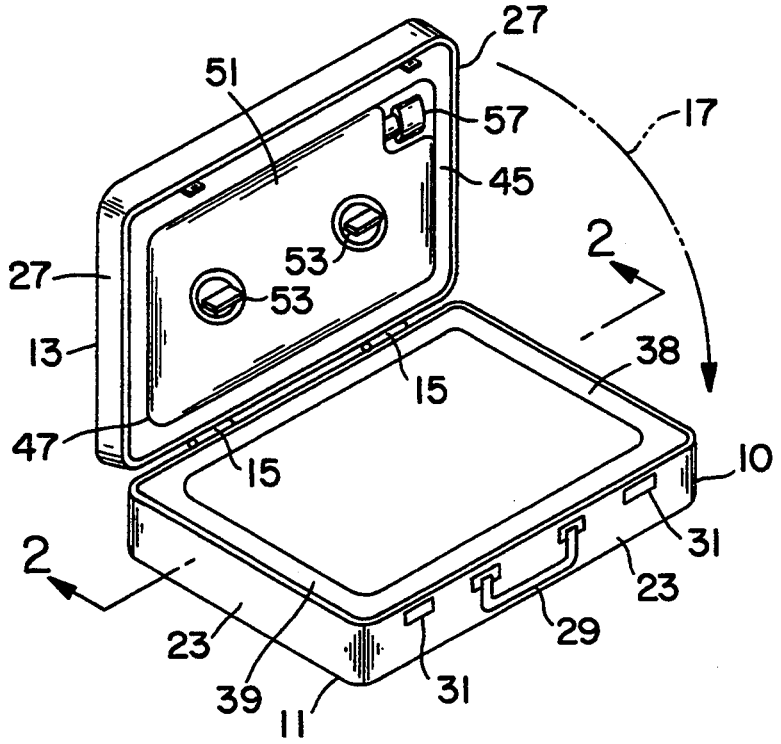
Figure 2:
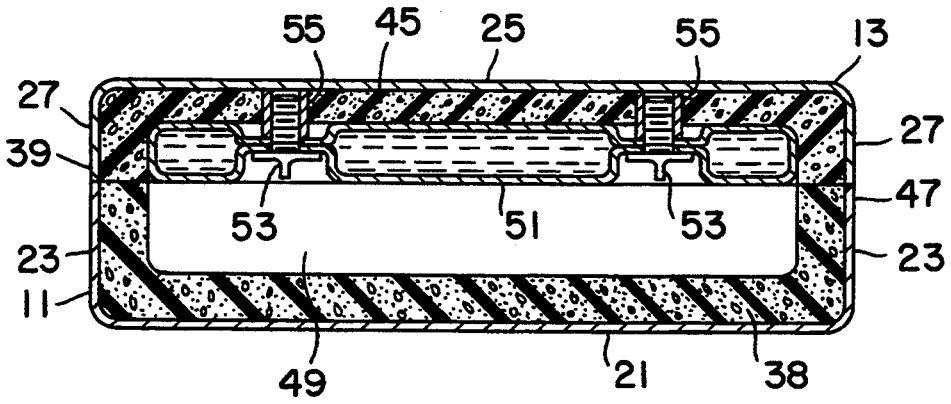

Referring to FIGS. 1 and 2, there is shown a food-carrying case 10 that comprises a tray 11 and a lid 13 interconnected by conventional hinges 15, whereby the lid can be swung downwardly to a closed position on the tray, as indicated by the arcuate arrow 17.

Tray 11 has a flat rectangular bottom wall 21 and four upstanding side walls 23. Lid 13 comprises a flat top wall 25 and four depending side walls 27. Both the tray and lid can be formed of plastic or sheet steel having an outer plastic covering that has the ornamental appearance of leather. When the lid is closed the case has the appearance of a conventional attache case.

The case is equipped with a carrying handle or shoulder strap 29 and two conventional latches 31 for holding the tray and lid together in a closed configuration. The case can be constructed in various sizes, depending to a certain extent on whether the case is to be used by an adult or by a child attending school. The adult version would normally be about sixteen inches long, twelve inches wide, and four or five inches thick. The children's version of the case would normally have smaller width and length dimensions.

Tray 11 has a concave molded foam liner 38 fitting therein, said liner 38 extending entirely around the associated compartment, i.e. along the tray bottom wall 21 and tray side walls 23. Lid 13 has a similarly constructed foam liner 45. In the illustrated embodiment each molded foam liner has essentially the same size and wall thickness. The liner material can be a closed cell foam rubber material or a closed cell foamed plastic material. Preferably, each liner is compressible, and has a smooth non-absorbent skin for cleaning or washing purposes. Each liner can be retained in its respective compartment by suitable adhesives. Alternately the liner can be molded into the tray or lid.

The upper annular edge 39 of foam liner 38 is flat and generally coincident with the upper edges of the tray side walls 23, as viewed in FIG. 2. Similarly the lower edge of foam liner 45 is flat and generally coincident with the lower edges of lid 13.

As previously noted, foam liner 45 is constructed similarly to the described foam liner 38, except that it is somewhat shallower due to the fact that lid 13 has a lesser thickness than tray 11. Each foam liner 45 can be permanently mounted in its lid compartment, using a conventional adhesive. As seen in FIG. 2, the lower annular edge 47 of each foam liner 45 is substantially coincident with the lower edges of the lid side walls 27 so that when the lid is in its closed position annular edges 39 and 47 of the respective liners are sealably engaged together. Liner surfaces 39 and 47 may protrude slightly beyond the associated side walls 23 and 27 so as to form a compression seal when the lid is closed. The mating foam liners 38 and 45 thus cooperatively form a complete insulative wall around any food item placed within the space 49 circumscribed by the mating foam liners.

A thermal bottle 51 is detachably secured to lid 13 by means of two thumb screws 53. Each thumb screw 53 is extended through an opening in a recessed portion of the bottle 51 wall for threaded engagement in an internally threaded sleeve 55 that extends downwardly from the lid top wall 25. The thermal bottle can be removed from the lid compartment by unscrewing the thumb screws 53 from the associated sleeves 55.

As best seen in FIG. 1, bottle 51 has a filler neck that is closed by a screw-on cap 57. Any suitable liquid coolant or gel can be poured into the bottle and retained therein by the associated cap 57. Prior to placement of bottle 51 in lid 13 the bottle may be stored overnight in a refrigerator to freeze the bottle liquid. The bottle will be placed in lid 13 on the morning of intended uses.

Figure 3:
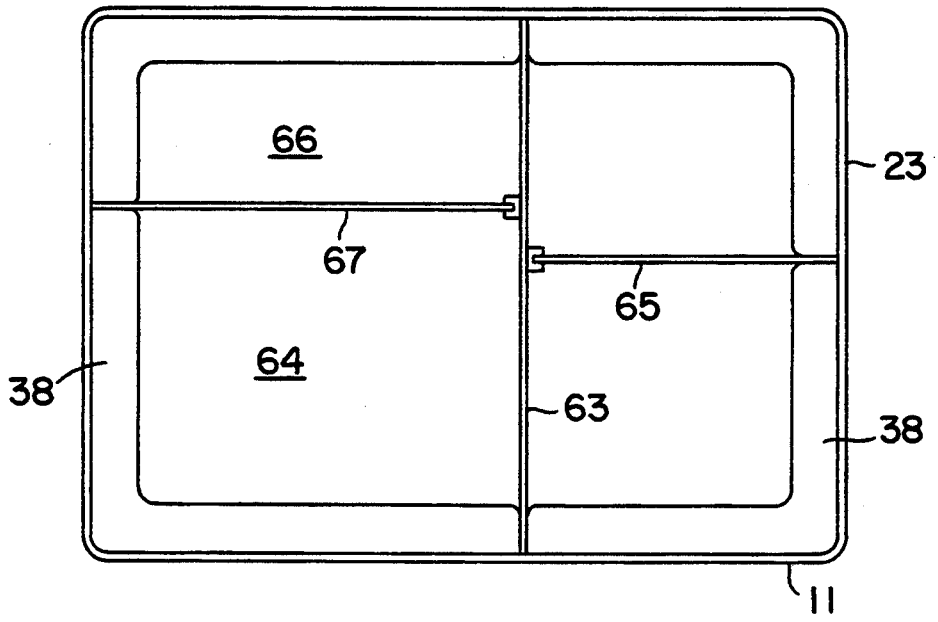
Figure 4:
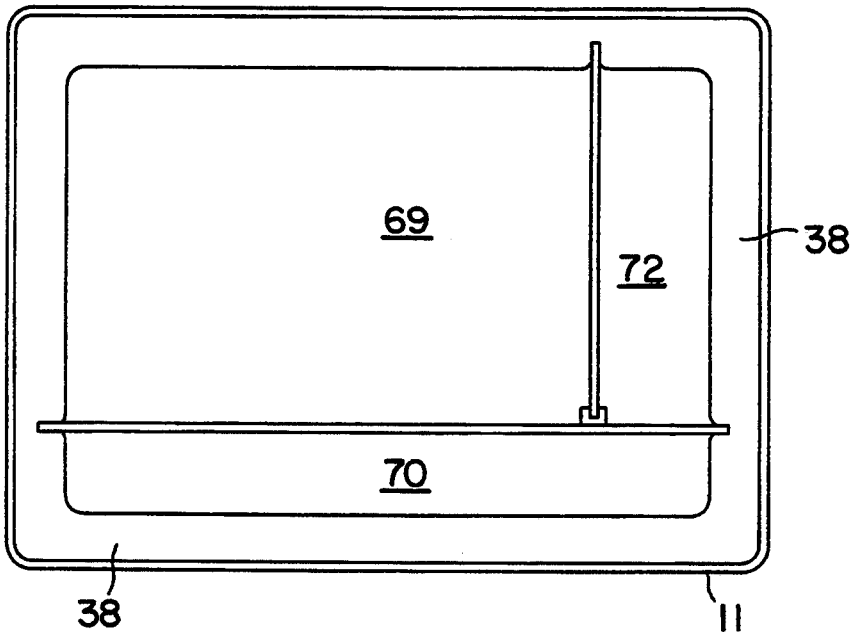

FIGS. 1 and 2 illustrate a case having a single compartment for containment of a person's lunch. FIGS. 3 and 4 show ways in which the tray portion of the case can be partitioned. The associated lid is not shown in FIGS. 3 and 4, although it should be understood that in each case an insulated lid matable with the tray will be used.

The tray shown in FIG. 3 is subdivided into four compartments by means of three removable partitions 63, 65 and 67. End areas of these partitions extend into vertical slots formed in the foam liner or slots in brackets attached to side surfaces of the abutted partitions. Preferably the three partitions 63, 65 and 67 can be removed for the purpose of cleaning the partition surfaces or the tray surface. The foam liners in the lid and tray will mate together in the same manner as depicted in FIG. 2 of the drawings. Each partition 63,65 and 67 has a height that is slightly less than the compartment height, such that the partitions have clearance with respect to bottle 51. The upper edges of the partitions are preferably rounded.

The various compartments can have different dimensions, depending partly on the overall size of the tray. For example, the compartment designated by numeral 64 can have a width dimension of five and one half inches and a length dimension of five and one half inches; such dimensions are suitable for containment of a sandwich. The compartment designated by numeral 66 can have a length of five and one half inches and a width of two and three fourth inch; such dimensions are sufficient for holding a can of pop. The other compartments can be used to contain yogurt or fruit, for example.

FIG. 4 illustrates an alternate arrangement wherein the insulated tray is partitioned to form one relatively large insulated compartment 69 and two relatively small insulated compartments 70 and 72. The associated lid (not shown) will be constructed as shown in FIGS. 1 and 2 of the drawings.

The smaller compartments 70 and 72 can be used to contain eating utensils, e.g. knives and forks, or napkins, or condiments, such as salt and pepper. The partitions that are used to form the compartments are preferably removable for cleaning purposes.

In the arrangements depicted in FIGS. 3 and 4 the foam liner 38 has slots molded therein to receive the ends of the associated partitions 63, 65, 67, etc. The foam liner material is resilient and deformable, but yet rigid enough to support the partitions. As shown in FIG. 3, the slots in the foam liner are of sufficient depth that the partitions contact the tray side wall 23. FIG. 4 shows slots in the foam liner 38 as having a lesser depth, so that the partitions do not come into contact with the tray side walls. In either case, the slots will retain and position the partitions in their designated locations. As noted previously,.the partitions are removable.

The flat portion of foam liner 38 extending along the tray bottom wall is preferably smooth and continuous for insulation efficiency and for ease in cleaning. The upstanding partitions are supported solely by the slots shown in FIGS. 3 and 4.

The drawings show various partition arrangements that can be used to form one or more insulated compartments. An important feature of the invention is the foam liner construction and arrangement, whereby the annular edge of each tray foam liner sealably engages the annular edge of the mating lid foam liner when the lid is closed. This feature provides a complete surroundment of the foam liner material around the thermal bottle and any food items placed in the respective insulated compartment.

While the drawings show specific structural features and arrangements useful in practice of the invention, it will be appreciated that the invention can be protected in various forms and configurations.

What is claimed is:

1. A closable food-carrying case comprising:

a rigid shallow tray having a rectangular bottom wall and four upstanding side walls; said side walls having upper edges located in a common plane;

a first concave foam liner fitting within said tray; said first foam liner extending entirely around said tray; said first foam liner having an upper annular edge substantially coincident with the upper edges of the tray side walls;

a rigid openable lid comprising a top wall and four depending side walls; said lid side walls having lower edges thereof located in a common plane;

a second concave foam liner fitting within said lid; said second foam liner extending entirely around said lid; said second liner having a lower annular edge substantially coincident with the lower edges of the lid side walls so that when the lid is closed the lower annular edge of the second liner is sealably engaged with the upper annular edge of the first liner;

each said foam liner being formed of a closed cell foam material that is compressible; each foam liner having thermal insulation properties;

a thermal bottle dimensioned to fit within the space circumscribed by said second foam liner; and means for detachably mounting said thermal bottle in said lid;

said second foam liner having a flat section thereof sandwiched between the lid top wall and the thermal bottle to insulate against heat transfer between the bottle and the lid top wall;

said bottle mounting means comprising at least one internally threaded sleeve extending from the lid top wall through and beyond the flat section of said second foam liner, and a screw extending through the bottle into the threaded sleeve to secure the bottle to the sleeve;

the annular edges of the foam liners protruding slightly beyond the edges of the associated side walls so that when the lid is closed the liners form a compression seal; said foam liners cooperatively forming a complete insulative wall around the thermal bottle and food items placed in the tray.

2. The case of claim 1, wherein said first foam liner has at least three vertical slots extending downwardly from its upper annular edge;

a first upstanding partition having opposite ends thereof extending into two of the slots in the tray foam liner; and a second upstanding partition extending normal to said first partition; said first partition having a vertical slot therein; said second partition having one end thereof extending into the third slot in the tray foam liner, and the other end thereof extending into the slot in the first partition; said partitions being removable from the tray foam liner for cleaning purposes; each partition being a flat rigid panel.

* * * * *